US008550002B2

(12) United States Patent
Reunamäki

(10) Patent No.: US 8,550,002 B2
(45) Date of Patent: Oct. 8, 2013

(54) ARRANGEMENT FOR SUPPORTING MORTAR SHELL INTO BREECH-LOADING WEAPON BARREL

(75) Inventor: Kari Reunamäki, Tampere (FI)

(73) Assignee: Patria Land Systems Oy, Helsinki (FI)

( * ) Notice: Subject to any disclaimer, the term of this patent is extended or adjusted under 35 U.S.C. 154(b) by 111 days.

(21) Appl. No.: 12/811,013

(22) PCT Filed: Jan. 30, 2009

(86) PCT No.: PCT/FI2009/050077

§ 371 (c)(1),
(2), (4) Date: Jul. 13, 2010

(87) PCT Pub. No.: WO2009/095539

PCT Pub. Date: Aug. 6, 2009

(65) Prior Publication Data

US 2010/0282114 A1 Nov. 11, 2010

(30) Foreign Application Priority Data

Jan. 31, 2008 (FI) ..... 20085074

(51) Int. Cl.
*F42B 15/00* (2006.01)
*F42B 5/02* (2006.01)
*F42B 30/08* (2006.01)

(52) U.S. Cl.
USPC ..... 102/293; 102/372; 102/439; 102/469; 102/483

(58) Field of Classification Search
USPC ..... 102/372, 373, 374, 376, 380, 430, 102/439, 445, 469, 470, 473, 483, 293, 520
See application file for complete search history.

(56) References Cited

U.S. PATENT DOCUMENTS

| | | | | | |
|---|---|---|---|---|---|
| 2,657,630 | A | * | 11/1953 | Blacker | 102/372 |
| 2,872,864 | A | * | 2/1959 | Barnes et al. | 102/436 |
| 3,635,162 | A | * | 1/1972 | Lohkamp et al. | 102/395 |
| 3,915,091 | A | | 10/1975 | Smith et al. | |
| 4,119,037 | A | | 10/1978 | Romer et al. | |
| 4,763,577 | A | | 8/1988 | Romer et al. | |

(Continued)

FOREIGN PATENT DOCUMENTS

| | | | |
|---|---|---|---|
| CN | 1269008 | A | 10/2000 |
| EP | 0 120 215 | A1 | 10/1984 |
| EP | 0 506 150 | A2 | 1/1992 |
| EP | 1 712 873 | A1 | 10/2006 |
| FI | 108965 | B | 4/2002 |
| FI | 112700 | B | 12/2003 |
| JP | 2000-65500 | A | 3/2000 |
| WO | WO 98/33018 | | 7/1998 |

*Primary Examiner* — James Bergin
(74) *Attorney, Agent, or Firm* — Birch, Stewart, Kolasch & Birch, LLP

(57) ABSTRACT

An arrangement for supporting a mortar shell into a breech-loading weapon barrel (2). The arrangement comprises a support piece (6) provided with an edge flange (7) and to be attached to the tail of the mortar shell (1), whereby the arrangement further comprises a connecting piece (8) between the support piece and the mortar shell tail, which connecting piece is arranged to be attached to the mortar shell and the support piece and thus to attach the support piece with a mechanical joint to the mortar shell tail. In connection with the connecting piece (8), there is a point which is arranged to yield in a firing situation and thus to allow the mortar shell (1) to be detached from the support piece (6); and a firing mechanism (17) for firing the actual primer (10) of the mortar shell. The mechanical joint between the connecting piece (8) and the support piece (6) has been formed by means of cotter attachment (14).

9 Claims, 2 Drawing Sheets

(56) References Cited

U.S. PATENT DOCUMENTS

Figure 1:
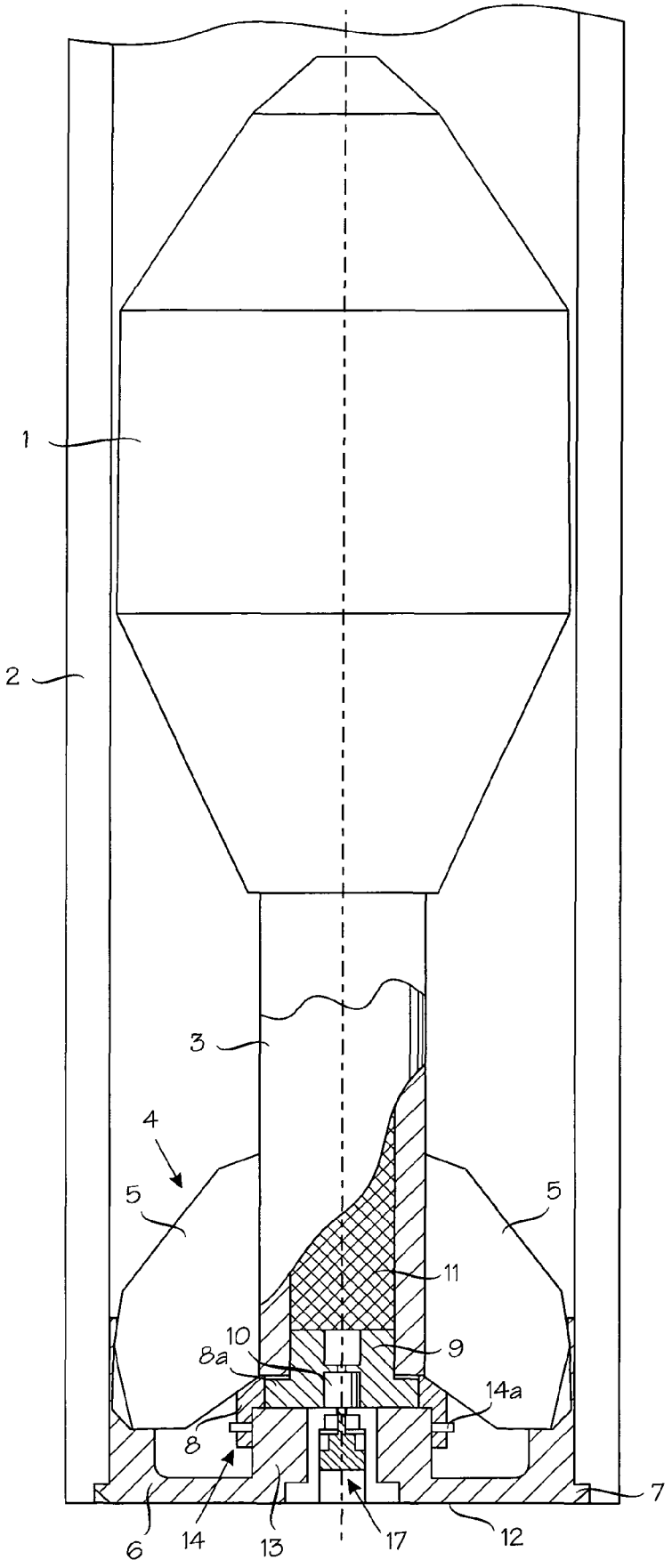

| | | | | |
|---|---|---|---|---|
| 5,503,080 | A * | 4/1996 | Goward et al. | 102/293 |
| 5,816,343 | A * | 10/1998 | Markel et al. | 175/4.51 |
| 5,945,628 | A | 8/1999 | Roheim | |
| 6,257,148 | B1 | 7/2001 | Toivonen et al. | |
| 6,772,693 | B2 * | 8/2004 | Kuru et al. | 102/293 |
| 8,336,460 | B2 * | 12/2012 | Tiainen et al. | 102/439 |
| 8,356,554 | B2 * | 1/2013 | Nurminen et al. | 102/445 |
| 8,430,030 | B2 * | 4/2013 | Kautto et al. | 102/293 |
| 2004/0107857 | A1 | 6/2004 | Kuru et al. | |

* cited by examiner

ARRANGEMENT FOR SUPPORTING MORTAR SHELL INTO BREECH-LOADING WEAPON BARREL

The invention relates to an arrangement for supporting a mortar shell into a breech-loading weapon barrel, the arrangement comprising a support piece provided with an edge flange and to be attached to the tail of the mortar shell, whereby the arrangement further comprises a connecting piece between the support piece and the mortar shell tail, which connecting piece is arranged to be attached to the mortar shell and the support piece and thus to attach the support piece with a mechanical joint to the mortar shell tail, there being, in connection with the connecting piece, a point which is arranged to yield in a firing situation and thus to allow the mortar shell to be detached from the support piece; and a firing mechanism for firing the actual primer of the mortar shell.

A mortar may be arranged on an appropriate moving base, for instance in an armoured vehicle, whereby the mortar can be moved from one place to another in a preferred manner and, on the other hand, quickly transferred away from an emplacement, for example to a safe place after firing or to a new emplacement.

If a heavy mortar is mounted on a movable base, it is not often easy to mount sufficiently heavy cannon defences on the same base for the purpose of defence, for example. In such a case, it is to be noted that light automatic armament is often insufficient against threats which are farther away, for example antitank defences, tanks or other artillery.

Due to the above aspects, it would be preferable to be able, in some conditions, to use a smooth-bore barrel mortar for firing also in the horizontal direction with direct laying, and even downwards. Such firing is not possible with a mortar in a normal situation because the problem is that the mortar shell does not stay in place in the smoothbore barrel of the mortar but may slide forwards in the barrel in such a way that it cannot be fired any longer.

Various solutions have been provided to solve the above problem. One example of known solutions is the solution disclosed in U.S. Pat. No. 5,503,080. In this known solution, a separate guide and attachment piece is used in the projectile tail of the mortar. The solution is based on the use of notches dimensioned according to the projectile tail, i.e. the projectile tail is inserted into the notches, whereby the tail is attached to the notches by means of friction joint. A drawback of this solution is that the above-mentioned friction joint does not provide sufficiently reliable attachment, which results in the reliability performance of the projectile being insufficient. In this context, it is to be noted that there are always some variations resulting from the manufacture in the dimensions of the guiding fins of a mortar shell, for example, which causes variation in friction forces and thereby in the magnitude of the attachment force of the mortar shell.

Various new solutions have been provided to eliminate disadvantages of the above known solution. Examples of such solutions include the solutions disclosed in FI patent publications 108965 and 112700. The solutions of FI patent publications 108965 and 112700 have eliminated drawbacks of the operating principle of the solution according to U.S. Pat. No. 5,503,080, and thus a very good reliability has been achieved for a projectile. The basic principle in the solutions of FI publications 108965 and 112700 is the use of a threaded joint. However, using a threaded joint results is relatively laborious, in other words it is relatively laborious to fit parts together and then rotate one part in relation to another in such a way that required attachment is achieved. It is to be noted that in real situations there may often be situations where the users of a mortar or the support persons of mortar users must act extremely quickly. Further, it is to be noted that automation of a threaded joint implementation is not an easy task.

An object of the invention is to provide an arrangement for supporting a mortar shell into the barrel of a breech-loading weapon, by means of which drawbacks of the prior art can be eliminated. This has been achieved with an arrangement which is characterized in that the mechanical joint between the connecting piece and the support piece has been formed by means of cotter attachment.

It is an advantage of the invention, above all, that the invention allows time-consuming rotating to be avoided, and still, a joint is provided which tolerates normal environmental stresses without opening. Further, an advantage of the invention is that it is structurally simple and, further still, that the solution can be automated fairly easily.

Figure 2:
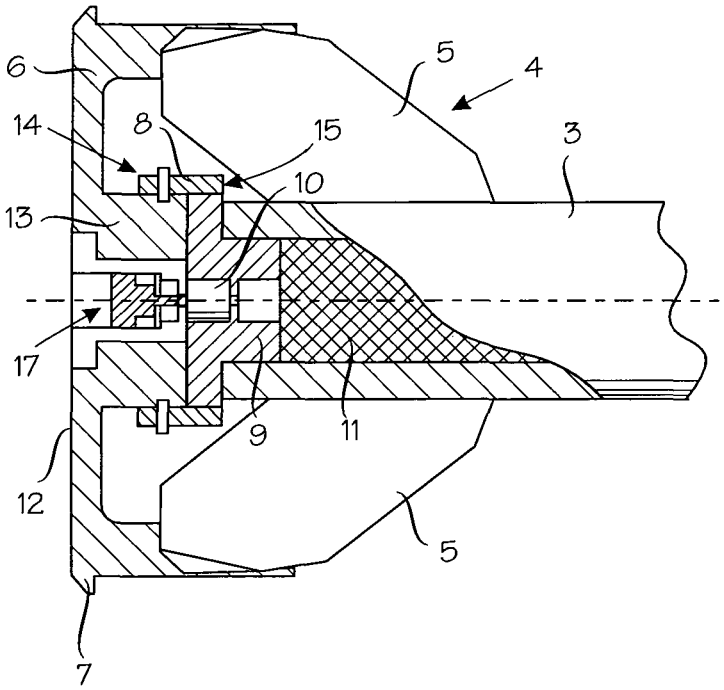
Figure 3:
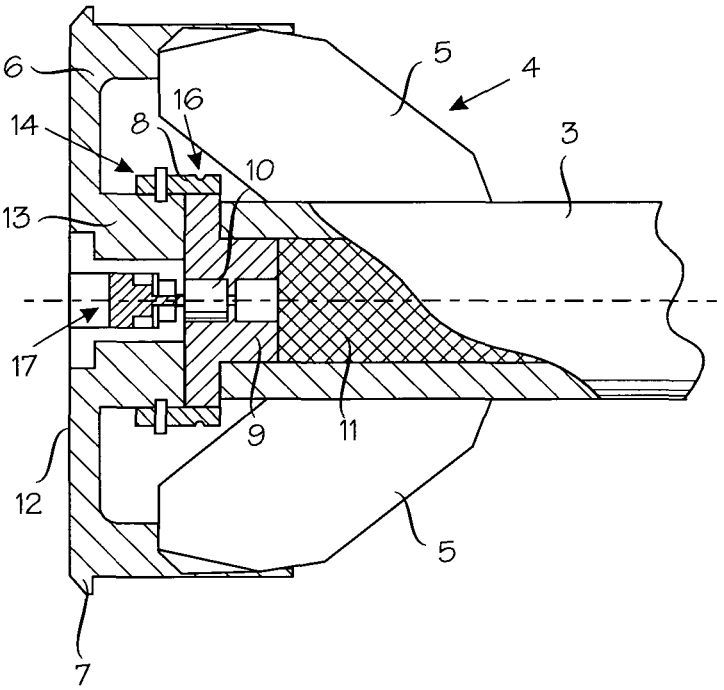

In the following, the invention will be explained with reference to the examples of the figures in the attached drawing, whereby FIG. 1 shows a principled view of a mortar shell supported into the barrel of a weapon by means of a first embodiment of the arrangement according to the invention;

FIG. 2 shows a principled view of a second embodiment of the arrangement according to the invention; and FIG. 3 shows a principled view of a third embodiment of the arrangement according to the invention.

FIG. 1 shows a principled view of a first embodiment of the arrangement according to the invention. A mortar shell 1 is arranged into a barrel 2 of a breech-loading weapon. The weapon may be, for example, a mortar where the inner surface of the barrel is substantially smooth. The weapon may be placed in an armoured vehicle, for instance. The rear part of the mortar shell 1 is provided with a tail tube 3 and a tail 4. The tail 4 comprises one or typically several guiding fins 5 for affecting the trajectory of the mortar mortar shell 1. FIG. 1 shows the mortar shell only by way of principle, and thus it is obvious that details of the construction of the mortar shell may deviate from the structure of FIG. 1. For the sake of clarity, the breech of the weapon and other details are not shown in the figures.

The above aspects as well as other aspects relating to the details of the mortar shell and the weapon are included in the general expertise of a person skilled in the art, so they are not described in more detail in this context.

In the embodiment of FIG. 1, the tail 4 of the mortar shell is provided with a support piece 6, with which the mortar shell 1 is retained in place in the barrel 2 until it is fired. A rim flange 7 in the support piece 6 prevents the mortar shell from moving forwards in the barrel 2 when the barrel 2 is directed horizontally or downwards. The support piece 6 is dimensioned in such a way that it tolerates the forces not only the loads caused by the mass of the mortar shell but also any forces caused by vibration and acceleration.

In addition to the above elements, the embodiment of FIG. 1 also comprises a connecting piece 8 arranged to be attached both to the mortar shell 1 and to the support piece 6 and thus to attach the support piece 6 to the tail 4 of the mortar shell by means of a mechanical joint, and further to retain the mortar shell 1 in place in the barrel 2 by means of the rim flange 7, as described above.

In the embodiment of FIG. 1, the connecting piece 8 is attached to the mortar shell 1 by means of a separate attachment piece 9. By means of the separate attachment piece 9, also a primer 10 has been installed in place at the end of the tail tube 3 of the mortar shell. The separate attachment piece 9 has been installed in place by means of a threaded joint.

Normally, when mortar shells are fired with a mortar, a firing mechanism 17 of the mortar strikes the actual primer 10, as a result of which a propelling charge 11 is fired and the mortar shell 1 is thrown out of the barrel. The primer firing mechanism 17 can be any suitable solution. In this context, the solution principle disclosed in FI patent publication 108965 is referred to as an example.

In the embodiment of the invention according to FIG. 1, the connecting piece 8 has a thin flange part 8*a* arranged to remain between the end of the tail tube 3 of the mortar shell and the separate attachment piece 9, whereby the connecting piece is attached to the mortar shell 1.

The support piece 6 comprises, in addition to the rim flange 7, also an end part 12 and a central sleeve part 13. The rim flange 7 forms a circular extension of the end part. The sleeve part is positioned in the middle of the end part in such a way that it protrudes axially from the support piece 6.

The connecting part 8 is, in the embodiment of FIG. 1, formed as a part whose one end is attached to the tail of the mortar shell, as described above, the inner surface of the other, substantially cylindrical end being arranged to surround the sleeve part 13 of the support piece 6 and to press simultaneously against the outer surface of the sleeve part, as described in FIG. 1.

In accordance with an essential idea of the invention, the mechanical joint between the connecting piece 8 and the support piece 6 is formed by means of cotter attachment 14. The cotter attachment 14 is formed by means of at least one attachment cotter 14*a* and cotter holes formed in the connecting piece 8 and the sleeve part of the support piece 6. The embodiment of FIG. 1 shows, in a principled manner, an application where there are several attachment cotters 14*a*, whereby the cotters are arranged at a distance from each other in the direction of the periphery of the support piece 6 and the connecting piece 8.

Thus, the support piece 6 is attached to the tail of the mortar shell 1 with a mechanical joint by using the connecting piece 8.

In connection with the connecting piece 8, there is a point arranged to yield in a firing situation and thus to allow the mortar shell to be detached from the support piece 6. In the embodiment of FIG. 1, the above-mentioned point may be, for example, a thin flange part 8*a* which is dimensioned in such a way that it forms a point which yields in a mortar shell firing situation and allows thus the mechanical joint between the mortar shell 1 and the support piece 6 to open.

The above-mentioned point dimensioned to yield in a firing situation may also be formed by means of a cotter joint 14, in other words by dimensioning the cotters 14*a* of the cotter joint in such a way that the cotter joint yields in a mortar shell firing situation.

The basic idea of the invention shown in FIG. 1, i.e. the cotter joint between the support piece 6 and the connecting piece 8, can also be applied in a slightly different manner. FIG. 2 shows, in a principled manner, a second embodiment. In FIG. 2, the same reference numerals are used in corresponding points as in FIG. 1. FIG. 2 only shows the tail part of the mortar shell and structures relating to it. In the embodiment of FIG. 2, the mechanical joint between the connecting piece 8 and the separate attachment piece 9 attached to the tail 4 of the mortar shell is formed by means of matching threads arranged on the outer periphery of the separate attachment piece 9 and on the inner surface of the connecting piece 8. The threads form a threaded joint 15. The threads of the threaded joint may preferably be dimensioned in such a way that the threads yield in a firing situation.

In the embodiment of FIG. 2, the point yielding in a firing situation may, in principle, be formed in the same way as in the embodiment of FIG. 1, in other words by means of a cotter joint 14 or by forming a threaded joint 15 in such a way that the threads yield, as described above. For example, the connecting piece 8 may be manufactured of such a material that its threads forming a part of the threaded joint 15 break or is shaped when a mortar shell is fired. The connecting piece 8 may also be manufactured of such a material that it is always in a firing situation that part of the arrangement which yields or breaks and thus causes the mortar shell to be detached from the support piece 6 in a firing situation.

FIG. 3 shows a third embodiment of the invention. In FIG. 3, the same reference numerals are used in corresponding points as in FIG. 1 and FIG. 2. FIG. 3 only shows the tail part of the mortar shell and structures relating to it. In the embodiment of FIG. 3, the connecting piece 8 is provided with a weakening part 16 dimensioned in such a way that the connecting piece breaks by this point in a mortar shell firing situation. The weakening point 16 may be, for instance, a groove extending around the connecting piece in the direction of the periphery. The weakening point enables determination of the point where the yielding or breaking takes place in a firing situation.

With relation to the prior art, an essential idea of the invention is specifically that the joint between the support piece 6 and the connecting piece 8 can be provided quickly and without time-consuming rotation steps. The invention also enables preferred automation of the attachment between the support part and the connecting part in an easy manner.

The embodiments of the invention shown in the figures are not, by any means, intended to restrict the invention but the invention may be applied completely freely within the scope of the claims. Details of the examples of FIGS. 1 to 3 may also be combined completely freely etc.

The invention claimed is:

1. An arrangement for supporting a mortar shell into a breech-loading mortar weapon barrel, the arrangement comprising:

a support piece provided with an edge flange and to be attached to the tail of the mortar shell, the support piece being arranged to keep the shell in place in the barrel until it is fired;

a connecting piece between the support piece and the mortar shell tail, the connecting piece being arranged to be attached to the mortar shell and the support piece and thus to attach the support piece with a mechanical joint to the mortar shell tail; and a firing mechanism for firing the actual primer of the mortar shell, wherein the mechanical joint between the connecting piece and the support is formed by means of cotter attachment, and wherein a point on at least one of the connecting piece and the cotter attachment is configured to yield when the mortar shell is fired, to instantly disengage the mechanical joint and to allow the mortar shell to be instantly detached from the support piece at the firing moment.

2. An arrangement according to claim 1, wherein the cotter attachment is formed by means of at least one attachment cotter.

3. An arrangement according to claim 2, wherein the cotter attachment is formed by means of several attachment cotters which are arranged at a distance from each other in the direction of the periphery of the support piece and the connecting piece.

4. An arrangement according to claim 1, wherein the cotter joint is dimensioned in such a way that it forms a point which yields in a firing situation.

5. An arrangement according to claim 1, wherein the connecting piece comprises a flange part which is, by means of an attachment piece to be arranged in the tail of the mortar shell, arranged to attach the connecting piece to the mortar shell, the flange part being dimensioned in such a way that it forms a point which yields in a firing situation.

6. An arrangement according to claim 1, wherein the connecting piece is provided with a weakening point dimensioned in such a way that it forms a point which yields in a firing situation.

7. An arrangement according to claim 6, wherein the weakening part is a groove extending around the connecting piece in the direction of the periphery.

8. An arrangement according to claim 1, wherein the connecting piece is made of a material which yields in a firing situation.

9. An arrangement according to claim 1, wherein the connecting piece is arranged to be attached to the attachment piece arranged in the tail of the mortar shell by means of a threaded joint, the threaded joint being dimensioned in such a way that the threads yield in a firing situation.

* * * * *